United States Patent [19]

Shoen et al.

[11] Patent Number: 4,898,626

[45] **Date of Patent: * Feb. 6, 1990**

[54] ULTRA-RAPID HEAT TREATMENT OF GRAIN ORIENTED ELECTRICAL STEEL

[75] Inventors: Jerry W. Shoen; David E. Margerum, both of Middletown, Ohio

[73] Assignee: Armco Advanced Materials Corporation, Lyndora, Pa.

[ * ] Notice: The portion of the term of this patent subsequent to Feb. 6, 2007 has been disclaimed.

[21] Appl. No.: 173,698

[22] Filed: Mar. 25, 1988

[51] Int. Cl.[4] ..... H01F 1/04

[52] U.S. Cl. ..... 148/111; 148/112; 148/122

[58] Field of Search ..... 148/111, 112, 113, 122

[56] References Cited

U.S. PATENT DOCUMENTS

| | | | |
|---|---|---|---|
| 2,965,526 | 12/1960 | Wiener | 148/111 |
| 3,114,364 | 8/1964 | Robinson et al. | 148/113 |
| 3,948,691 | 4/1976 | Matsushita et al. | 148/112 |
| 4,115,161 | 9/1978 | Benford et al. | 148/111 |
| 4,469,533 | 9/1984 | Inokut et al. | 148/111 |
| 4,545,828 | 10/1985 | Shoen et al. | 148/111 |
| 4,576,658 | 3/1986 | Inokuti et al. | 148/111 |
| 4,585,916 | 4/1986 | Rich | 219/10.61 R |

OTHER PUBLICATIONS

Szymura and Zawada, "The Effect of the Heating Rate During Primary Recrystallization . . . ", *Arch. Hutn.,* 1978 23 (1) pp. 29–33.

S. L. Semiation et al., "Improved Sheet Steels by Rapid Annealing", *Metal Progress,* 4/87, pp. 43–50.

*Primary Examiner*—John P. Sheehan

*Attorney, Agent, or Firm*—L. A. Fillnow; R. J. Bunyard; R. H. Johnson

[57] ABSTRACT

Ultra-rapid annealing of grain oriented electrical steel to a temperature prior to the final high temperature anneal results in improved texture and smaller secondary grain size. The ultra-rapid anneal requires heating the strip to a temperature above about 675° C. (1250° F.) at a rate above 100° C. per second (180° F. per second). The ultra-rapid anneal is performed after the first stage of cold rolling and prior to or as part of the decarburization anneal. The material will survive a subsequent stress relief anneal and may be further improved by various domain treatments. The ultra-rapid anneal increases productivity and procedures improved core loss properties.

8 Claims, 4 Drawing Sheets

GRAIN SIZE DISTRIBUTION VERSUS ULTRA-RAPID HEATING REGION

ULTRA-RAPID HEAT TREATMENT OF GRAIN ORIENTED ELECTRICAL STEEL

BACKGROUND OF THE INVENTION

The present invention provides an ultra-rapid annealing treatment for both regular and high permeability grain oriented electrical steel prior to decarburizing to provide a smaller secondary grain size and lower core loss after the final high temperature anneal.

Electrical steels having up to 6.5% silicon have a final grain size and texture which determines the magnetic properties of the material. The grain size and texture will depend on the annealing temperatures, percent reductions, atmospheres, times and inhibitor systems used in the production of the electrical steel. For purposes of an exemplary showing, the invention will be applied to cube-on-edge oriented electrical steel having the (110)[001] orientation as designated by the Miller's indices. Grain oriented electrical steels are normally referred to as either regular grain oriented or high permeability grain oriented. Regular grain oriented grades generally have a permeability at 796 A/m of less than 1870 whereas high permeability grades have a permeability greater than 1870. U.S. Pat. No. 3,764,406 is typical of regular grain oriented electrical steel and U.S. Pat. Nos. 3,287,183; 3,636,579; 3,873,381 and 3,932,234 are typical of high permeability grain oriented electrical steel. The objective is to provide a steel capable of preferentially forming and sustaining the growth of (110)[001] oriented secondary grains, thereby providing these electrical steels with a sharp (110)[001] texture. The above patents teach typical routings for casting a melt composition into ingots or slabs, hot rolling, annealing, cold rolling in one or more stages, subjecting the cold rolled strip to an annealing treatment which serves to recrystallize the steel, reduce the carbon content to a nonaging level and form a fayalite surface oxide, coating the annealed strip with a separator coating and subjecting the strip to a final high temperature anneal within which the process of secondary grain growth occurs. A forsterite or "mill" glass coating is formed by reaction of the fayalite layer with the separator coating. Secondary grain growth occurs during the final high temperature anneal, but the prior processing stages establish the proper distribution of grain growth inhibitors and the texture required for secondary grain growth.

To increase the percentage of crystals having the preferred (110)[001] orientation, U.S. Pat. No. 2,965,526 used heating rates of 1600° C. to 2000° C. per minute (50° F. to 60° F. per second) to recrystallize oriented electrical steel strip between two stages of cold rolling. The intermediate recrystallization anneal was conducted at a soak temperature of 850° C. to 1050° C. (1560° F. to 1920° F.) for less than one minute to avoid undue crystal growth. The strip is again cold rolled and given a second rapid anneal, heating at 1600° C. to 2000° C. per minute (50° F. to 60° F. per second) and held at a temperature of 850° C. to 1050° C. (1560° F. to 1920° F.) to soften the material for a period of less than one minute. After the second rapid anneal, the material is decarburized at 600° C. to 800° C. (1110° F. to 1470° F.) in wet hydrogen and given a final high temperature anneal at 1000° C. to 1300° C. (1830° F. to 2370° F.). The rapid heating rates were believed to cause the strip to pass quickly through the temperature range within which undesirable crystal orientations grow and to attain a temperature within which the preferred crystal orientations grow.

U.S. Pat. No. 4,115,161 used a similar rapid heat treatment during the heating stage of the decarburizing anneal for boron-inhibited silicon steels which were stated to have processing characteristics unlike conventional silicon steels. The proper heating rate was stated to improve magnetic properties by allowing the use of a more oxidizing atmosphere during the decarburizing anneal without incurring unduly high loss of boron during the anneal. The cold rolled strip was rapidly heated from 833° C. to 2778° C. per minute (225° F. to 82° F. per second) to a temperature of 705° C. to 843° C. (1300° F. to 1550° F.). The strip was held at temperature for at least 30 seconds, and preferably for 1–2 minutes, to minimize boron lost at the surface while reducing the carbon content to less than 0.005% and providing a surface oxide scale capable forming a higher quality forsterite, or mill glass, coating after the subsequent high temperature anneal.

A Russian article by Szymura and Zawada, "Effect of the Heating Rate During Primary Recrystallization on the Properties of the Fe-3 Percent Si Alloy After Secondary Recrystallization", *Arch. Hutn.*, 1978, 23, (1), pages 29–33, studied the influence of heating rate during primary recrystallization of cold rolled electrical steel. Electrical steel strip was hot rolled, decarburized, initially cold rolled, intermediate annealed, finally cold rolled and subjected to primary recrystallization annealing using heating rates from 1.2° C. to 180,000° C. per minute (0.04° F. to 5400° F. per second) to a temperature of 950° C. (1740° F.) in a dry hydrogen atmosphere, after which the strip is subjected to a high temperature final anneal to induce secondary grain growth. The magnetic properties produced during this study were not acceptable for regular grain oriented requirements. The optimum texture was developed at 50° C. per second (90° F. per second). Heating rates above 100° C. per second (180° F. per second) drastically reduced the texture. The Russian theory proposed the heating rate formed a greater number of (110)[001] nuclei during primary recrystallization. A smaller secondary grain size was believed to result from the increased number of nuclei. However, the steelmaking process of this article differs considerably from the generally accepted art wherein the decarburizing step is conducted on cold rolled strip prior to the final anneal.

It is important to note that the ultra-rapid anneal of the present invention heats the entire strip and should not be confused with the techniques of local radio frequency induction heating or resistance heating for domain refinement such as taught by U.S. Pat. No. 4,545,828 or U.S. Pat. No. 4,554,029. In U.S Pat. No. 4,545,828, the local treatment causes the primary grains to grow at least 30–50% larger than the untreated bands to act as temporary barriers to secondary grain growth and which are eventually to be consumed by the growing secondary grains. In U.S. Pat. No. 4,554,029, the material has already been given the final high temperature anneal before the locally heated treated bands have the microstructure altered to regulate the size of the magnetic domains after a further high temperature anneal.

BRIEF SUMMARY OF THE INVENTION

The present invention relates to a process for improving the primary recrystallization texture of grain oriented electrical steel by adjusting the heating rate and peak temperature prior to the strip decarburization/-fayalite formation anneal and the high temperature final anneal processes. The magnetic properties are improved as a result of ultra-rapidly heating the material at a rate in excess of 100° C. per second (180° F. per second) to a temperature above the recrystallization temperature, nominally 675° C. (1250° F.). The ultra-rapid annealing treatment can be accomplished as a replacement for the existing normalizing annealing treatment, a pre-anneal recrystallization treatment prior to conventional annealing treatment or integrated into presently utilized conventional process annealing treatment as the heat-up portion of the anneal.

It is a principal object of the present invention to provide a magnetic material with improved core loss owing to the development of a smaller secondary grain size and/or higher permeability after completion of the high temperature anneal. The improvements are capable of surviving a stress relief anneal.

It is a further object of the present invention to include the rapid heat treatment as part of the decarburization heat treatment to improve productivity.

It is also a further object of the present invention to provide a process which encourages secondary grain growth by improving the primary recrystallization texture.

Another object of the present invention is to provide a rapidly annealed magnetic material which subsequently can be modified by various bulk or localized treatments providing further improvement in the magnetic properties.

The above and other objects, features and advantages of the present invention will become apparent upon consideration of the detailed description and appended drawings.

DESCRIPTION OF THE PREFERRED EMBODIMENT

Figure 1:
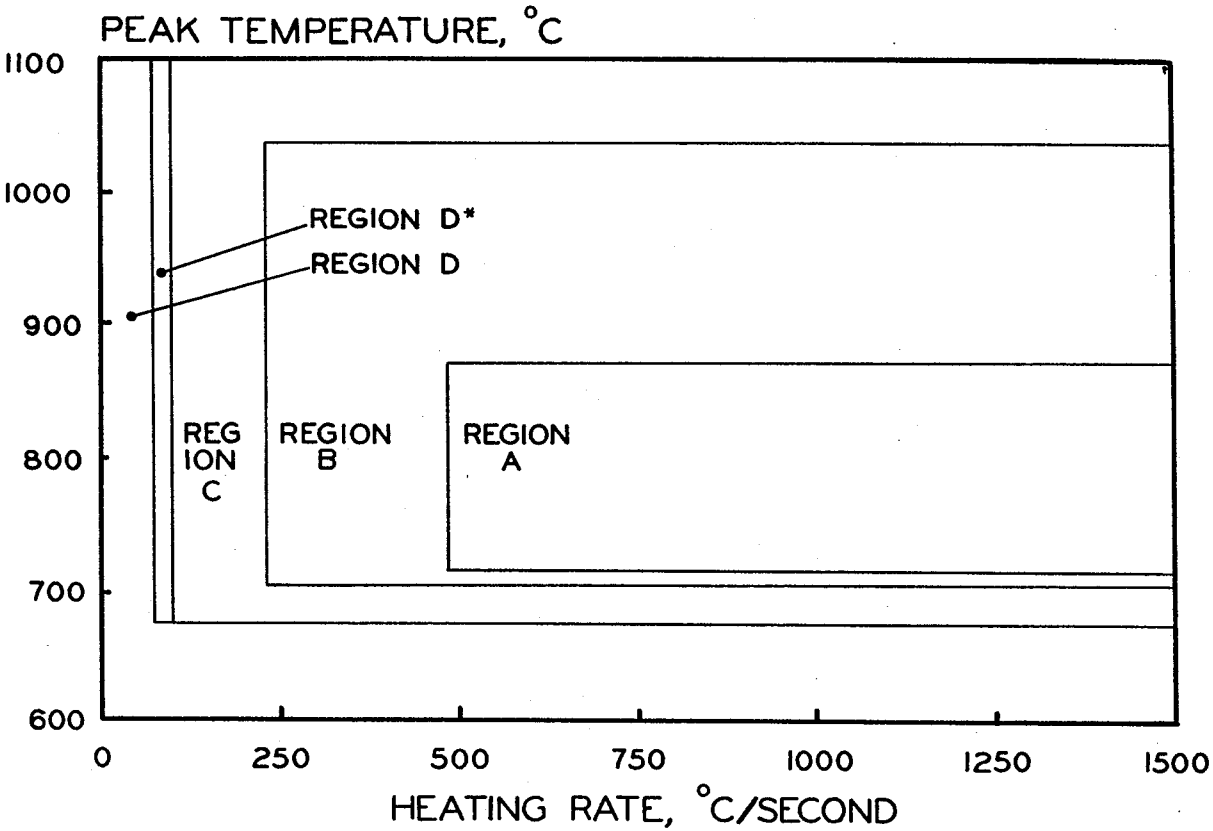
FIG. 1 is a semi-diagrammatic plan showing the effective ranges for heaing rate and peak temperature within the practice of the present invention.

The formation of the (110)[001], or Goss, texture in grain oriented electrical steels is a complex metallurgical system to control. The superior magnetic properties are the result of a preferred <100> crystal orientation in the sheet rolling direction developed in the final high temperature anneal after which substantially the entire sheet is comprised of large grains having orientations near the ideal (110)[001]. Great strides have been made in the processing of (110)[001] oriented electrical steels, resulting in materials having high levels of magnetic permeability which reflects the high degree of perfection in the <100> crystal orientation. (110)[001] oriented electrical steels are characterized by containing less than 6.5% silicon and not more than 0.10% carbon. Typically, the (110)[001] texture develops as primary grains having orientations at or near (110)[001] grow at the expense of other primary grains having different orientations during the process termed secondary grain growth or secondary recrystallization. The energy driving the process of secondary grain growth may be derived from several sources. The energy may be provided by the elimination of large portions of grain boundary area of the fine-grained primary matrix. Surface energy differences between grains of different orientations may also be the source to cause secondary grain growth which results in a highly oriented texture. The composition of the annealing atmosphere and restricted impurity levels in the base material also contribute to the regulation of preferred textures. The electrical steel, after the final high temperature anneal, will have a degree of texturing above 90% in the (110)[001] direction.

The present invention provides a method to achieve a substantial improvement in the magnetic quality of (110)[001] oriented silicon steel by improving the primary recrystallization texture established prior to the inception of secondary grain growth in the high temperature anneal. This is achieved by utilizing an ultra-rapid heat treatment to a temperature above which recrystallization of the cold rolled sheet occurs. The ultra-rapid annealing treatment can be performed as either a pre-anneal recrystallization treatment or can be integrated into an existing process anneal whereby the ultra-rapid annealing heat-up can be utilized to eliminate the lengthy heating portion of the annealing cycle, thereby improving productivity.

As indicated above, the starting material of the invention is a material suitable for the manufacture of regular or high permeability grain oriented electrical steel containing less than 6.5% silicon with certain necessary additions such as manganese, sulfur, aluminum, nitrogen, selenium, antimony, copper, boron, tin, molybdenum or the like, or combinations thereof, to provide a grain growth inhibiting effect according to the teachings of the art. These steels are produced by a number of routings well known in the art using the usual steelmaking and ingot or continuous casting processes, hot rolling, annealing and cold rolling in one or more stages to final gauge. Strip casting, if commercialized, would also produce material which would benefit from the present invention.

According to the present invention, the cold rolled strip, which is of intermediate or final gauge, and which has not yet been given the final high temperature anneal is subjected to an ultra-rapid annealing treatment. The secondary grain orientation and grain size depend on the chemistry and processing. The inventive practice does not guarantee specific properties in the final product. Rather, the ultra-rapid anneal represents an improvement in processing practice which will typically improve the core loss properties by about 5–6% for high permeability grain oriented steel and 1–3% for regular grain oriented electrical steel.

FIG. 1 illustrates the ranges for the heating rate and peak temperature using ultra-rapid annealing on high permeability grain oriented electrical steel performed prior to or as part of a conventional decarburizing annealing treatment. Regions A, B and C represent process conditions within the more preferred, preferred and broad ranges of ultra-rapid annealing. Region D represents the region where the pre-decarburization anneal or the heating portion of the anneal are within the range of or produced results equivalent to conventional practices. Within Region D, the process of texture selection which occurs upon recrystallization proceeds normally. Refinement of the secondary grain size may be obtained after high temperature annealing with annealing rates above 75° C. per second (135° F. per second) but the magnetic properties are not significantly changed until the heating conditions are in the range defined by Region C. Within the broad range defined by Region C, the beneficial effects of ultra-rapid annealing are evident. Region C is defined by utilizing ultra-rapid annealing heating rates in excess of 100° C. per second (180° F. per second) to a temperature above which recrystallization occurs, nominally 675° C. (1250° F.). Satisfactory results have been obtained at peak temperatures as high as 1040° C. (1900° F.). Within Region C the core loss properties are improved and the secondary grain size is significantly reduced. A more preferred practice is defined by Region B which utilized ultra-rapid heating rates in excess of 230° C. per second to a peak temperature between 705° C. (1300° F.) and 985° C. (1805° F.). The most preferred practice is defined by Region A which utilized ultra-rapid heating rates in excess of 485° C. per second (875° F. per second) to a peak temperature between 715° C. (1320° F.) and 870° C. (1600° F.). The upper limit for annealing rates is not limited to the scale in FIG. 1 but may extend up to several thousand °C. per second.

Figure 2:
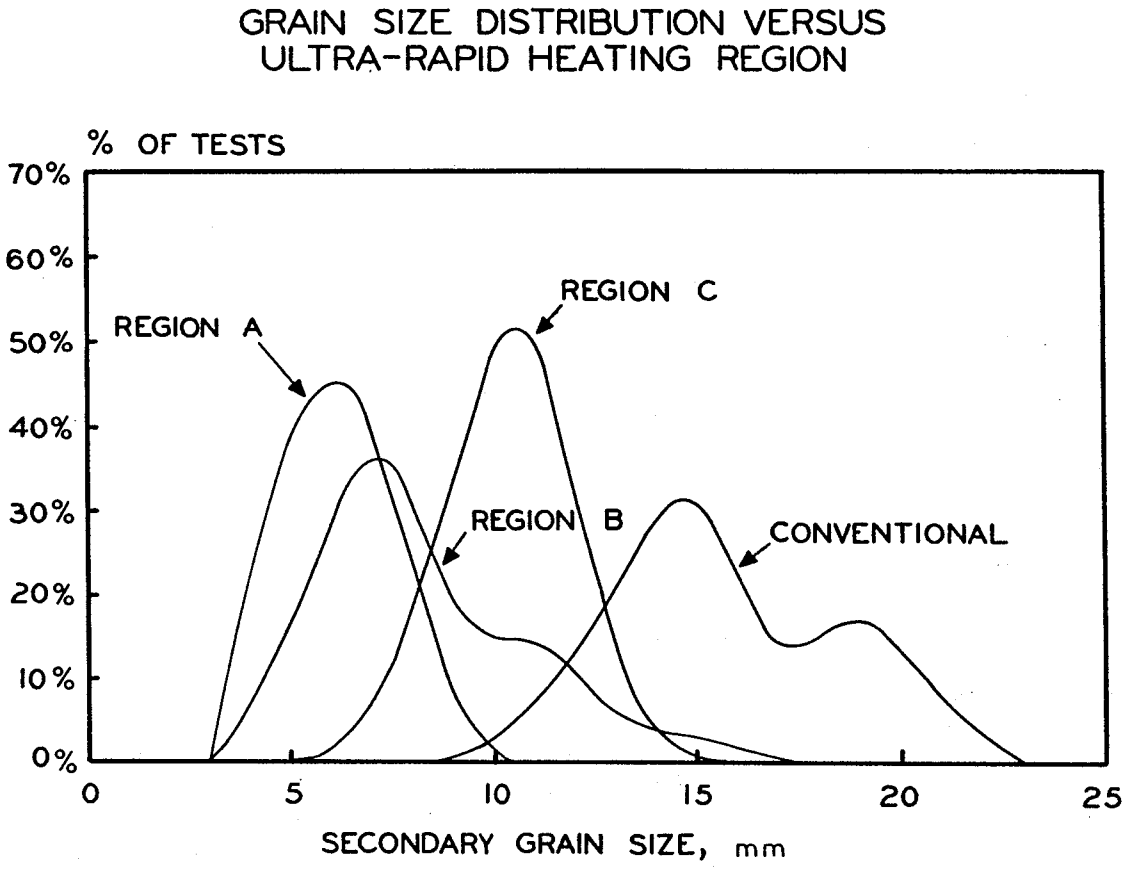
FIG. 2 shows the secondary grain size distribution for a 0.25 mm thick high permeability electrical steel processed within the boundary conditions defined in FIG. 1.
Figure 3:
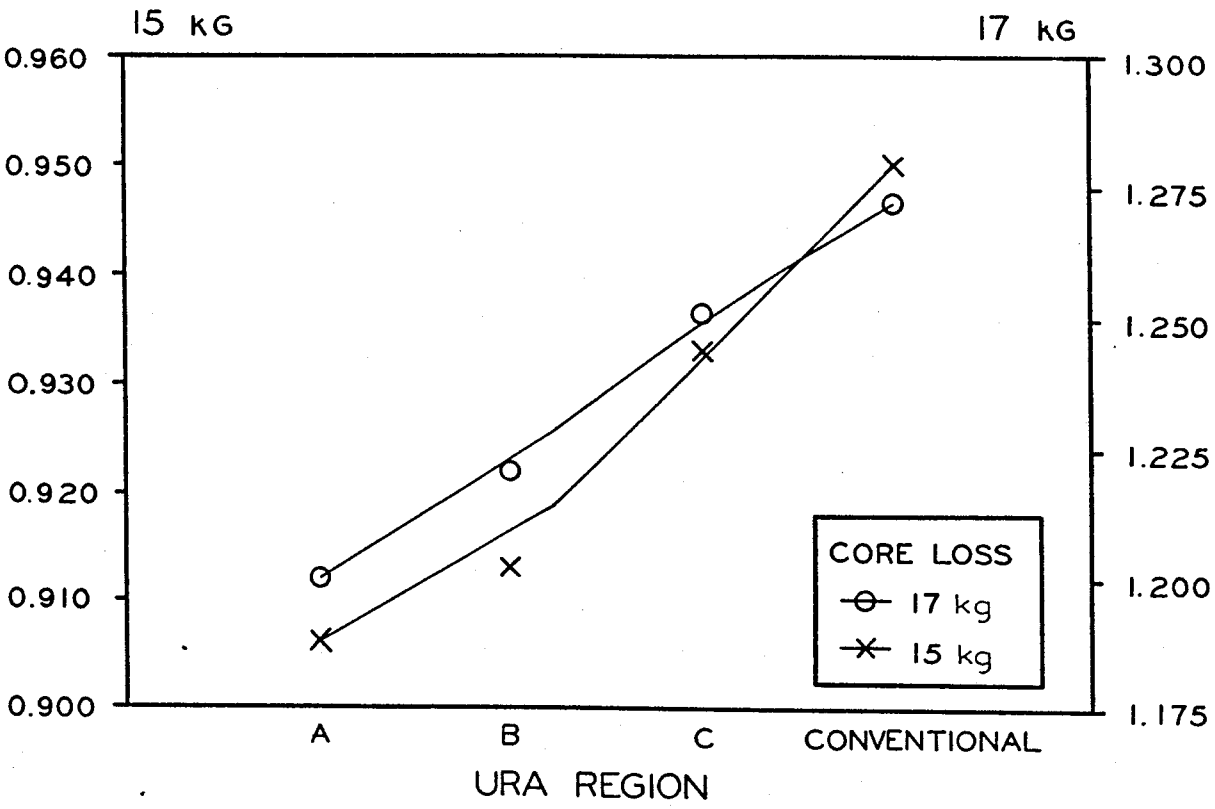
FIG. 3 shows the effect of practice of the present invention on the core loss at 15 kG and 17 kG and 60 Hz on a 0.25 mm thick high permeability electrical steel processed within the boundary conditions defined in FIG. 1.

FIGS. 2 and 3 illustrate the secondary grain size distribution and core loss at 17 kG and 15 kG and 60 Hz test induction for 0.25 mm thick high permeability grain oriented electrical steel processed within ranges A, B and C defined in FIG. 1 and compared to material processed by fully conventional decarburization annealing practices. As can be seen, the ultra-rapid annealing treatment served to refine the secondary grain size and improve the core loss, compared to comparison samples with conventional processing. Refinement of the grain size does not insure improved core loss properties until the heating rates are above 100° C. per second (180° F. per second).

The mechanism by which the smaller secondary grain size and improved core loss are achieved in the practice of the present invention involves two changes achieved in the primary recrystallization texture prior to the final decarburization and high temperature annealing processing steps. Crystallite orientation distribution studies were made on specimens of 0.25 mm thick high permeability electrical steel processed by conventional decarburization and by an ultra-rapid annealing treatment within Region A of FIG. 1 prior to the decarburization anneal. The volume fraction of crystals having a near cube-on-edge orientation and which provide the nuclei to form the actively growing secondary grains, is significantly increased with ultrarapid annealing. Simply, this means that there are more potential cube-on-edge nuclei which form an actively growing secondary grain in the high temperature anneal with ultra-rapid annealing. Also, the amount of crystals having a near {111}<112> matrix texture is reduced with ultra-rapid annealing. Matrix crystals having this orientation are believed to provide an environment which fosters the rapid growth of the (110)[001] secondary grains during the high temperature anneal. Reduction in the intensity of near {111}<112> texture is believed to slow the rate of secondary grain growth, further allowing more potential (110)[001] nuclei to initiate active secondary growth.

There are several methods to heat strip rapidly in the practice of the present invention; including, but not limited to, solenoidal induction heating, transverse flux induction heating, resistance heating, and directed energy heating such as by lasers, electron beam or plasma systems. Solenoidal and transverse flux induction heating are especially suitable to the application of ultra-rapid annealing in high speed commercial applications because of the high power available and their energy efficiency.

Figure 4:
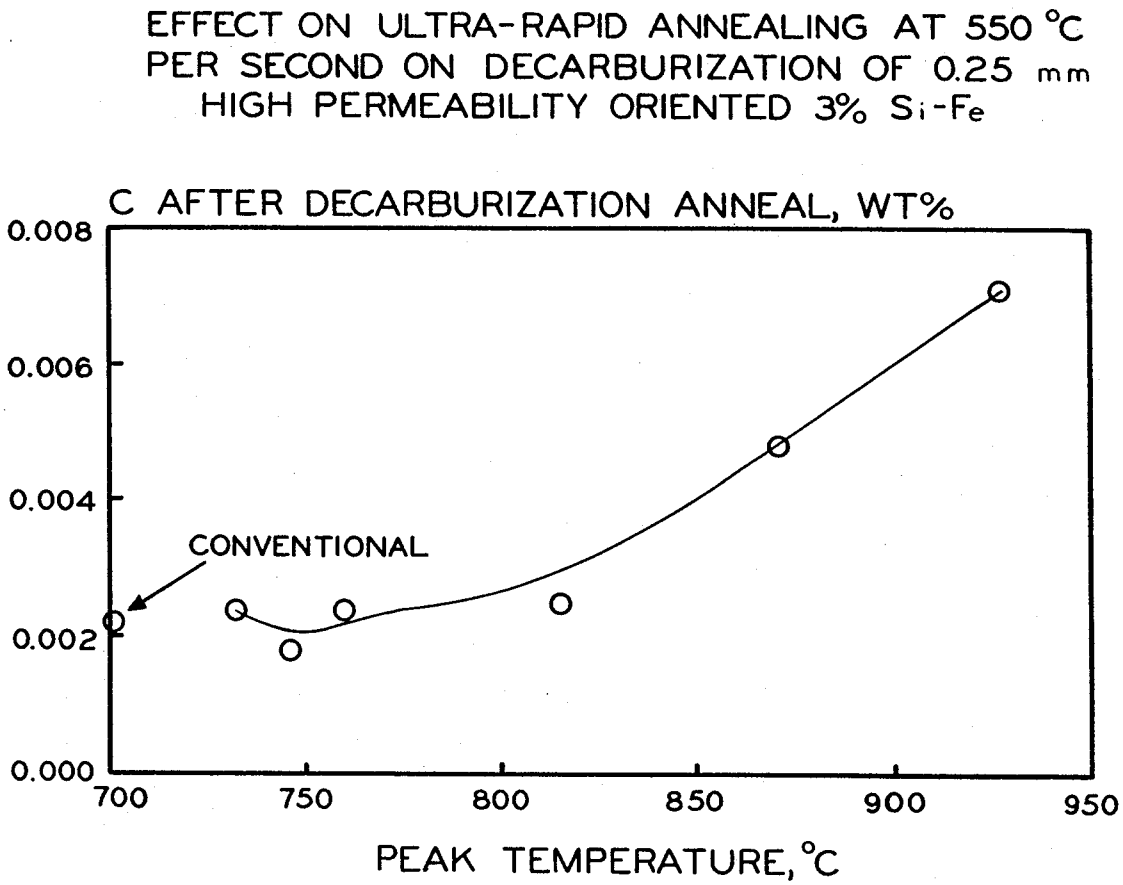
FIG. 4 is a graph showing the carbon remaining after decarburizing for a 0.25 mm high permeability electrical steel after being ultra-rapidly annealed at 555° C. per second to various peak temperatures.

Certain of the process technologies used in the manufacture of grain oriented electrical steels require a critical amount of carbon added at the melt stage in order to achieve the proper final properties. However, the carbon level must be reduced to a level of less than 0.003–0.005% to insure that the magnetic properties are not degraded by aging, i.e., the precipitation of iron carbide, while in use. Generally, this is accomplished by decarburization of the cold rolled strip in an oxidizing atmosphere prior to the high temperature anneal. The criticality of this process requires that the carbon be substantially removed before the steel surface is oxidized, which produces a barrier to further carbon removal from the strip. FIG. 4 shows that carbon removal in the decarburization annealing step can be impaired by ultra-rapid annealing if the peak temperature is allowed to exceed 850° C. (1560° F.), particularly for processes which require the use of very high initial carbon contents, greater than 0.030%. This can, of course, be compensated for by proper control of the ultra-rapid annealing peak temperature and atmosphere and/or of the subsequent decarburization annealing process which is well known in the art.

As indicated above, the ultra-rapid annealing process of the present invention can be performed at any point in the routing after at least a first stage of cold rolling and before the decarburization process (if any) preceding the final anneal. A preferred point in the routing is after the completion of cold rolling and before the decarburization annealing step (if required). The ultra-rapid anneal may be accomplished either prior to the decarburization anneal step or may be incorporated into the decarburization annealing step as a heat-up portion of that anneal.

The following examples illustrate various preferred embodiments of the invention but it will be understood that various modifications may be made without departing from the spirit and scope of the invention.

EXAMPLE I

A sample sheet of 2.1 mm (0.083 inch) thick hot-rolled steel sheet of composition (by weight) 0.056% C, 0.093% Mn, 0.036% Al, 2.96% Si, 0.025% S, 0.0075% N, 0.045% Sn and 0.12% Cu was subjected to hot band annealing at 1150° C. (2100° F.) for 1.5 minutes and cold-rolled to a thickness of 0.25 mm (0.010 inch). After cold rolling, the material was ultra-rapidly annealed by heating on a specially designed resistance heating apparatus at rates of 83° C. per second (150° F. per second), 140° C. per second (250° F. per second), 260° C. per second (470° F. per second), 280° C. per second (500° F. per second) and 555° C. per second (1000° F. per second) to peak temperatures of 555° C. (1930° F.), 667° C. (1030° F.), 722° C. (1230° F.), 750° C. (1380° F.), 764° C.

(1407° F.), 777° C. (1430° F.), 806° C. (1480° F.), 833° C. (1530° F.), 889° C. (1630° F.), 944° C. (1730° F.), 1000° C. (1830° F.) and 1056° C. (1930° F.) and cooled in a nonoxidizing atmosphere of 95% Ar-5% $H_2$. After the ultra-rapid annealing treatment, the strip samples along with samples which received no ultra-rapid annealing treatment were subjected to a conventional annealing treatment heating from ambient to 860° C. (1580° F.) in 60 seconds and soaking at temperature for 60 seconds in a wet $H_2$-$N_2$ or hydrogen-nitrogen atmosphere to reduce the carbon content to a level of 0.0035% or less and to form a fayalite oxide scale. The samples were slurry coated with MgO and subjected to a high temperature final anneal at 1200° C. (2190° F.) after which the excess MgO was scrubbed off and the samples stress relief annealed at 825° C. (1520° F.) in a 95% $N_2$-5% $H_2$ atmosphere. Afterwards, the mill glass coating was removed by acid pickling and the secondary grain sizes measured. These results are shown in Table I. The core loss at 17 kG and 60 Hz and the secondary grain sizes are shown graphically versus their respective process Regions in FIG. 2 and FIG. 3, respectively.

TABLE I

| 0.25 mm Thick High Permeability Electrical Steel | | | | | | | |
|---|---|---|---|---|---|---|---|
| | | | Magnetic Properties measured at 60 Hz | | | | |
| Sample | Ultra-Rapid Heating Rate (°C/Sec.) | Peak Temp. (°C.) | H = 796 A/m | 15 kG (W/kg) | Process 17 kG (W/kg) | Secondary Grain Size (mm) | Region |
| 1 | 83 | 538 | 1931 | 0.950 | 1.287 | 12.9 | D |
| 2 | 83 | 649 | 1950 | 0.943 | 1.252 | 15.9 | D |
| 3 | 83 | 649 | 1935 | 0.954 | 1.296 | 17.6 | D |
| 4 | 83 | 704 | 1918 | 0.985 | 1.239 | 7.7 | D* |
| 5 | 83 | 704 | 1930 | 0.943 | 1.272 | 8.0 | D* |
| 6 | 83 | 746 | 1944 | 0.985 | 1.298 | 9.5 | D* |
| 7 | 83 | 746 | 1928 | 0.952 | 1.265 | 9.1 | D* |
| 8 | 83 | 788 | 1949 | 0.943 | 1.228 | 7.7 | D* |
| 9 | 83 | 788 | 1937 | 0.952 | 1.272 | 6.9 | D* |
| 10 | 140 | 538 | 1929 | 0.930 | 1.252 | 15.9 | D |
| 11 | 140 | 538 | 1937 | 0.943 | 1.252 | 13.4 | D |
| 12 | 140 | 649 | 1927 | 0.893 | 1.208 | 19.6 | D |
| 13 | 140 | 649 | 1943 | 0.897 | 1.184 | 15.9 | D |
| 14 | 140 | 704 | 1945 | 0.928 | 1.228 | 9.8 | C |
| 15 | 140 | 746 | 1943 | 0.934 | 1.236 | 10.1 | C |
| 16 | 140 | 746 | 1934 | 0.923 | 1.212 | 10.5 | C |
| 17 | 140 | 788 | 1936 | 0.941 | 1.243 | 6.7 | C |
| 18 | 140 | 788 | 1941 | 0.948 | 1.247 | 7.4 | C |
| 19 | 140 | 982 | 1926 | 0.917 | 1.239 | 6.5 | C |
| 20 | 260 | 704 | 1912 | 0.957 | 1.298 | 9.8 | C |
| 21 | 260 | 816 | 1938 | 0.932 | 1.250 | 5.4 | B |
| 22 | 260 | 816 | 1937 | 0.908 | 1.214 | 5.2 | B |
| 23 | 260 | 871 | 1942 | 0.910 | 1.212 | 5.2 | B |
| 24 | 260 | 871 | 1938 | 0.912 | 1.241 | 5.6 | B |
| 25 | 260 | 927 | 1936 | 0.921 | 1.252 | 6.0 | B |
| 26 | 260 | 927 | 1935 | 0.901 | 1.214 | 5.6 | B |
| 27 | 260 | 982 | 1937 | 0.926 | 1.270 | 6.7 | B |
| 28 | 260 | 1,038 | 1935 | 0.912 | 1.243 | 9.1 | C |
| 29 | 260 | 1,038 | 1923 | 0.952 | 1.305 | 7.7 | C |
| 30 | 280 | 538 | 1930 | 0.952 | 1.289 | 12.9 | D |
| 31 | 280 | 538 | 1924 | 0.926 | 1.247 | 15.4 | D |
| 32 | 280 | 649 | 1936 | 0.998 | 1.340 | 15.9 | D |
| 33 | 280 | 649 | 1941 | 0.950 | 1.234 | 13.8 | D |
| 34 | 280 | 704 | 1939 | 0.934 | 1.239 | 12.1 | C |
| 35 | 280 | 704 | 1907 | 0.961 | 1.327 | 7.7 | C |
| 36 | 280 | 746 | 1939 | 0.915 | 1.214 | 6.7 | B |
| 37 | 280 | 746 | 1946 | 0.912 | 1.210 | 7.2 | B |
| 38 | 280 | 788 | 1947 | 0.952 | 1.245 | 9.5 | B |
| 39 | 280 | 788 | 1937 | 0.932 | 1.225 | 7.4 | B |
| 40 | 555 | 538 | 1935 | 1.082 | 1.283 | 15.4 | D |
| 41 | 555 | 538 | 1933 | 0.948 | 1.272 | 13.8 | D |
| 42 | 555 | 538 | 1928 | 1.093 | 1.298 | 13.4 | D |
| 43 | 555 | 649 | 1929 | 0.932 | 1.241 | 17.0 | D |
| 44 | 555 | 704 | 1939 | 0.934 | 1.239 | 12.1 | C |
| 45 | 555 | 704 | 1935 | 0.950 | 1.254 | 13.4 | C |
| 46 | 555 | 732 | 1944 | 0.906 | 1.188 | 4.3 | A |
| 47 | 555 | 732 | 1945 | 0.879 | 1.168 | 4.3 | A |
| 48 | 555 | 732 | 1945 | 0.910 | 1.208 | 5.1 | A |
| 49 | 555 | 746 | 1946 | 0.937 | 1.228 | 5.4 | A |
| 50 | 555 | 746 | 1940 | 0.895 | 1.192 | 4.7 | A |
| 51 | 555 | 746 | 1929 | 0.912 | 1.228 | 4.7 | A |
| 52 | 555 | 746 | 1943 | 0.908 | 1.192 | 4.3 | A |
| 53 | 555 | 746 | 1942 | 0.910 | 1.201 | 5.1 | A |
| 54 | 555 | 760 | 1938 | 0.886 | 1.175 | 5.4 | A |
| 55 | 555 | 760 | 1947 | 0.888 | 1.175 | 6.7 | A |
| 56 | 555 | 760 | 1940 | 0.893 | 1.188 | | A |
| 57 | 555 | 760 | 1941 | 0.893 | 1.177 | 4.1 | A |
| 58 | 555 | 788 | 1931 | 0.930 | 1.228 | 4.7 | A |
| 59 | 555 | 788 | 1923 | 0.926 | 1.225 | 4.6 | A |
| 60 | 555 | 816 | 1939 | 0.899 | 1.186 | 4.3 | A |
| 61 | 555 | 816 | 1940 | 0.901 | 1.181 | 4.7 | A |

TABLE I-continued

| 0.25 mm Thick High Permeability Electrical Steel Magnetic Properties measured at 60 Hz | | | | | | | |
|---|---|---|---|---|---|---|---|
| Sample | Ultra-Rapid Heating Rate (°C/Sec.) | Peak Temp. (°C.) | H = 796 A/m | 15 kG (W/kg) | Process 17 kG (W/kg) | Secondary Grain Size (mm) | Region |
| 62 | 555 | 816 | 1936 | 0.886 | 1.188 | 5.6 | A |
| 63 | 555 | 816 | 1941 | 0.910 | 1.219 | 5.2 | A |
| 64 | 555 | 816 | 1945 | 0.917 | 1.210 | 5.2 | A |
| 65 | 555 | 871 | 1945 | 0.904 | 1.197 | 5.6 | A |
| 66 | 555 | 871 | 1919 | 0.932 | 1.245 | 4.3 | A |
| 67 | 555 | 871 | 1943 | 0.893 | 1.184 | 5.1 | A |
| 68 | 555 | 871 | 1945 | 0.897 | 1.197 | 5.1 | A |
| 69 | 555 | 871 | 1943 | 0.910 | 1.208 | 5.4 | A |
| 70 | 555 | 871 | 1955 | 0.939 | 1.223 | 4.7 | A |
| 71 | 555 | 927 | 1943 | 0.910 | 1.250 | 6.0 | B |
| 72 | 555 | 927 | 1949 | 0.915 | 1.225 | 5.6 | B |
| 73 | 555 | 927 | 1934 | 0.906 | 1.225 | 5.4 | B |
| 74 | 555 | 927 | 1948 | 0.904 | 1.186 | 4.7 | B |
| 75 | 555 | 927 | 1942 | 0.897 | 1.195 | 4.0 | B |
| 76 | 555 | 927 | 1947 | 0.890 | 1.166 | 4.6 | B |
| 77 | 555 | 982 | 1940 | 0.912 | 1.223 | 6.7 | B |
| 78 | 555 | 982 | 1943 | 0.895 | 1.188 | 5.8 | B |
| 79 | 555 | 1,038 | 1941 | 0.932 | 1.265 | 9.1 | C |
| 80 | 555 | 1,038 | 1943 | 0.879 | 1.188 | 9.1 | C |
| | | | | | | | AVE |
| | | | 1941 | 0.950 | 1.272 | 14.8 | NORM |
| | | | 1940 | 0.906 | 1.200 | 4.9 | A |
| | | | 1941 | 0.913 | 1.221 | 5.9 | B |
| | | | 1934 | 0.933 | 1.251 | 9.3 | C |
| | | | 1934 | 0.960 | 1.262 | 8.2 | D* |
| | | | 1935 | 0.959 | 1.262 | 15.2 | D |

*Grain size refinement only.

The results of these studies clearly indicate the improved core loss resulting from ultra-rapid annealing above 100° C. per second (180° F. per second) prior to the decarburizing and final high temperature anneals. The material may be given a stress relief anneal without degradation of the intrinsic magnetic quality. Additionally, the material may be further improved by providing an insulative coating which imparts tension or by post-process domain refinement treatments.

EXAMPLE II

A sample sheet of 1.9 mm (0.075 inch) thick hot-rolled steel sheet of composition (by weight) 0.028% C, 0.060% Mn, 3.15% Si and 0.020% S was subjected to hot band annealing at 980° C. (1800° F.) for 1.5 minutes, cold-rolled to a thickness of 0.50 mm (0.02 inch), annealed at 950° C. (1740° F.) for 0.5 minutes and cold-rolled to a final thickness of 0.18 mm (0.007 inch). After cold rolling, the material was ultra-rapidly annealed during and as part of the heating portion of the decarburization anneal. The heating process was accomplished using a specially designed solenoidal induction heating coil with a fundamental frequency of 450 kHz which provided a heating rate of 1200° C. per second (2160° per second) to the Curie point, 746° C. (1375° F.), (conditions which lies within Region A of FIG. 1) after which the strip was heated at 30° C. per second (55° F. per second) from 746° C. (1375° F.) to soak temperature of 865° C. (1590° F.) and held for 30 to 60 seconds in a wet hydrogen-nitrogen atmosphere to effect decarburization and fayalite formation. Afterwards, the strip samples along with samples processed without an ultra-rapid heat-up treatment were slurry coated with MgO and subjected to a high temperature final anneal at 1200° C. (2190° F.) after which the excess MgO was scrubbed off and the samples stress relief annealed at 825° C. (1515° F.) in 95%N2-5% H2. The magnetic testing results are shown in Table II.

TABLE II

| 0.18 mm Thick Regular Grain Oriented Magnetic Properties Measured at 60 Hz | | | | | | | | |
|---|---|---|---|---|---|---|---|---|
| | Processed By Conventional Annealing | | | Processed by Ultra Rapid Annealing (This Invention) | | | Core Loss Improvement | |
| Sample | H = 796 A/m | 15 kG (W/kg) | 17 kG (W/kg) | H = 796 A/m | 15 kG (W/kg) | 17 kG (W/kg) | 15 kG (W/kg) | 17 kG (W/kg) |
| 1 | 1855 | 0.851 | 1.294 | 1856 | 0.829 | 1.263 | −0.022 | −0.031 |
| 2 | 1860 | 0.846 | 1.276 | 1862 | 0.824 | 1.245 | −0.022 | −0.031 |
| 3 | 1858 | 0.840 | 1.272 | 1857 | 0.833 | 1.261 | −0.007 | −0.011 |
| 4 | 1857 | 0.842 | 1.283 | 1855 | 0.831 | 1.263 | −0.011 | −0.020 |

The results of these studies clearly indicate the improved core loss can be achieved by performing the ultra-rapid annealing treatment during the heat-up portion of the decarburizing anneal prior to the final high temperature annealing. The data shows the benefits are permanent and the material may be given a stress relief anneal without degradation of the intrinsic magnetic quality.

EXAMPLE III

A sample sheet of 2.0 mm (0.079 inch) thick hot-rolled steel sheet of composition (by weight) 0.050% C, 0.090% Mn, 0.029% Al, 2.97% Si, 0.025% S, 0.0077% N, 0.043 Sn and 0.10% Cu was subjected to cold rolling to 1.7 mm (0.067 inch), annealing at 1150° C. (2100° F.) for 1.5 minutes and was again cold-rolled to a thickness of 0.225 mm (0.009 inch). After cold rolling, the material was ultra-rapidly annealed during and as part of the heating portion of the decarburization anneal. The heating process was accomplished using a specially designed solenoidal induction heating coil with a fundamental frequency of 450 kHz which provided a heating rate of 1100° C. per second (1980° F. per second) to the Curie point, 746° C. (1375° F.), (conditions which lies within Region A of FIG. 1) after which the strip was heated at 30° C. per second (55° F. per second) from 746° C. (1375° F.) to soak temperature of 870° C. (1780° F.) and held for 60 seconds in a wet hydrogen-nitrogen atmosphere to effect decarburization and fayalite formation. Afterwards, the strip samples along with samples processed without an ultrarapid heat-up treatment were slurry coated with MgO and subjected to a high temperature final anneal at 1200° C. (2190° F.) after which the excess MgO was scrubbed off and the samples stress relief annealed at 825° C. (1515° F.) in 95%$N_2$-5% $H_2$. The magnetic testing results are shown in Table III.

TABLE III

| | 0.23 mm Thick High Permeability Grain Oriented Magnetic Properties Measured at 60 Hz | | | | | | | |
|---|---|---|---|---|---|---|---|---|
| | Processed By Conventional Annealing | | | Processed by Ultra Rapid Annealing (This Invention) | | | Core Loss Improvement | |
| Sample | H = 796 A/m | 15 kG (W/kg) | 17 kG (W/kg) | H = 796 A/m | 15 kG (W/kg) | 17 kG (W/kg) | 15 kG (W/kg) | 17 kG (W/kg) |
| 1 | 1934 | 0.943 | 1.289 | 1932 | 0.884 | 1.201 | −0.060 | −0.088 |
| 2 | 1940 | 0.877 | 1.184 | 1939 | 0.846 | 1.137 | −0.031 | −0.046 |
| 3 | 1941 | 0.912 | 1.252 | 1933 | 0.864 | 1.186 | −0.048 | −0.066 |
| 4 | 1940 | 0.886 | 1.199 | 1938 | 0.855 | 1.162 | −0.031 | −0.037 |

The results of these studies clearly indicate the improved core loss can be achieved by performing the ultra-rapid annealing treatment during the heat-up portion of the decarburizing anneal prior to the final high temperature annealing. The data shows the benefits are permanent and the material may be given a stress relief anneal without degradation of the intrinsic magnetic quality.

EXAMPLE IV

A study was made to determine the influence of ultra-rapid annealing in combination with conventional preheating during the decarburizing anneal.

A 0.27 mm (0.011 inch) thick material having a composition, in weight %, of 2.97% silicon, 0.044% carbon, 0.095% manganese, 0.034% aluminum, 0.0066% nitrogen and balance essentially iron was used for the experiment. Three conditions were evaluated. Thermal cycle 1 represents conventional decarburizing which heats the strip at 25°-30° F. per second (about 15° C. per second) from room temperature to 1575° F. (857° C.) with a one minute soak. Thermal cycle 2 heated the same strip material from room temperature to 1375° F. (745° C.) using an ultra-rapid annealing rate of 1000° F. per second (555° C. per second) and finished the annealing at 25°-30° F. per second (about 15° C. per second) up to 1575° F. (857° C.) with a one minute soak. Thermal cycle 3 heated the same strip from room temperature to about 650° F. (345° C.) at 25°-30° F. per second (about 15° C. per second), then ultra-rapidly annealed at 1000° F. per second (555° C. per second) to 1375° F. (745° C.) and finish annealed at 25°-30° F. per second (about 15° C. per second) to 1575° F. (857° C.) with a one minute soak. The results are shown in Table IV. The magnetic properties are about the same for thermal cycles 2 and 3 which indicates the ultra-rapid anneal may be used in combination with existing equipment. The texture modification caused by the ultra-rapid anneal are related to the annealing processes of recovery and recrystallization. In electrical steels, recovery initiates at about 1000° F. (about 538° C.) and recrystallization is completed at about 1250° F. (about 675° C.). Thus the benefits of the present invention are obtainable if the strip is ultra-rapidly heated from about 1000° F. (538° C.) to above about 1250° F. (about 675° C.). Obviously, the benefits to productivity are increased if the ranges are extended.

TABLE IV

| | | 11 Mill High Permeability SRA Glass Film 1525° F. | | | |
|---|---|---|---|---|---|
| | H-10 | | | % Improvement | |
| Cycle | Perm | P15:60 | P17:60 | P15:60 | P17:60 |
| 1 | 1932 | 0.444 | 0.603 | — | — |
| 2 | 1938 | 0.428 | 0.567 | 4% | 6% |
| 3 | 1938 | 0.428 | 0.568 | 4% | 6% |

We claim:

1. A process for controlling secondary grain growth and improving the magnetic properties of grain oriented electrical steel strip containing less than 6.5% silicon, said process comprising the steps of subjecting said strip of final gauge to an ultra-rapid annealing treatment at a heating rate above 100° C. per second (180° F. per second) to a temperature above 675° C. (1250° F.), decarburizing and subjecting said strip to a final high temperature anneal for secondary growth, whereby said strip has secondary grains of reduced size a degree of texturing above 90% in the (110)[001] direction and improved core loss, which improvement will survive a stress relief annealing without any significant change in magnetic properties.

2. The process claimed in claim 1 wherein said ultra-rapid annealing treatment is conducted at a heating rate of at least 230° C. per second (415° F. per second) to a temperature of from 705° C. to 985° C. (1300° F. to 1805° F.).

3. The process claimed in claim 1 wherein said ultra-rapid annealing treatment is at a heating rate above 485° C. per second (875° F. per second) to a temperature of from 715° C. to 870° C. (1320° F. to 1600° F.).

4. The process claimed in claim 1, wherein the ultra-rapid annealing treatment is conducted as the heating portion of the decarburizing step.

5. The process claimed in claim 1 wherein the electrical steel melt contains, in weight %, 2%–4% silicon, less than 0.10% carbon, 0.001%–0.065% aluminum, 0.001%–0.010% nitrogen, 0.03%–0.2% manganese, 0.015%–0.07% sulfur or selenium, and balance essentially iron.

6. The process claimed in claim 1 wherein the ultra-rapid annealing of the strip is accomplished by resistance heating, induction heating or directed energy heating devices.

7. The process claimed in claim 1 wherein said finally annealed strip is given a treatment to provide domain refinement.

8. The process claimed in claim 1 wherein the ultra-rapid anneal is from at least about 450° C. to about 675° C. (about 1000° F. to 1250° F.) and is used in combination with normal heating rates up to the decarburizing temperature.

* * * * *